United States Patent [19]

Terzian et al.

[11] Patent Number: 4,471,565

[45] Date of Patent: Sep. 18, 1984

[54] ARTICULATED DOLL MOUNTED ON A BALL

[75] Inventors: Rouben T. Terzian, Chicago; Walter J. Wozniak, Addison; Harry Disko, South Barrington, all of Ill.

[73] Assignee: Marvin Glass & Associates, Chicago, Ill.

[21] Appl. No.: 461,970

[22] Filed: Jan. 28, 1983

[51] Int. Cl.[3] ..... A63H 11/10

[52] U.S. Cl. ..... 446/273; 446/325; 446/384

[58] Field of Search ..... 46/155, 116, 97, 100, 46/16 A, 103

[56] References Cited

U.S. PATENT DOCUMENTS

| | | | |
|---|---|---|---|
| 672,707 | 5/1901 | Mackin et al. | 46/100 |
| 907,092 | 12/1908 | Schoenhut | 46/155 |
| 1,248,729 | 12/1917 | Seidel | 46/100 |
| 1,393,583 | 10/1921 | Steverson | 46/100 |
| 2,403,531 | 2/1946 | Hoover et al. | 46/155 |
| 2,499,743 | 3/1950 | Goodman | 46/155 |
| 2,554,516 | 5/1951 | Anthony | 46/155 |
| 3,058,261 | 10/1962 | Lakin | 46/107 |
| 3,465,474 | 9/1969 | Gardel et al. | 46/164 |
| 4,203,251 | 5/1980 | Malek et al. | 46/107 |

*Primary Examiner*—Mickey Yu

*Attorney, Agent, or Firm*—John S. Pacocha

[57] ABSTRACT

An articulated doll mounted on a ball which contains an internal eccentric weight appears to dance and play with the ball. The torso of the doll is pivotally connected to the outside surface of the doll and legs hingedly connected to the torso are biased in toward the ball surface. The doll's head is connected to the torso for limited rotational movement about an axis and the center of gravity of the doll's head is offset from the axis so that the head moves from side-to-side as the ball wobbles about on a playing surface. Arms flexibly connected at one end to the torso have hands at the other end that are connected to the ball by extending pins permitting pivotal movement of the doll with respect to the ball.

20 Claims, 4 Drawing Figures

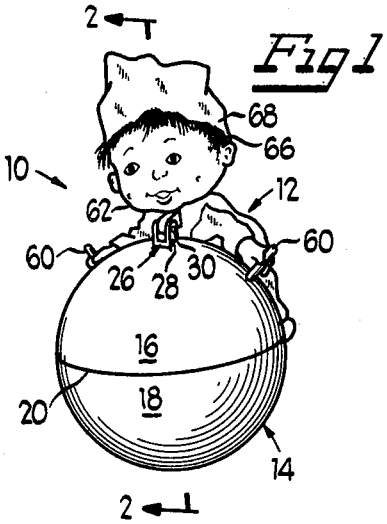
Fig 1
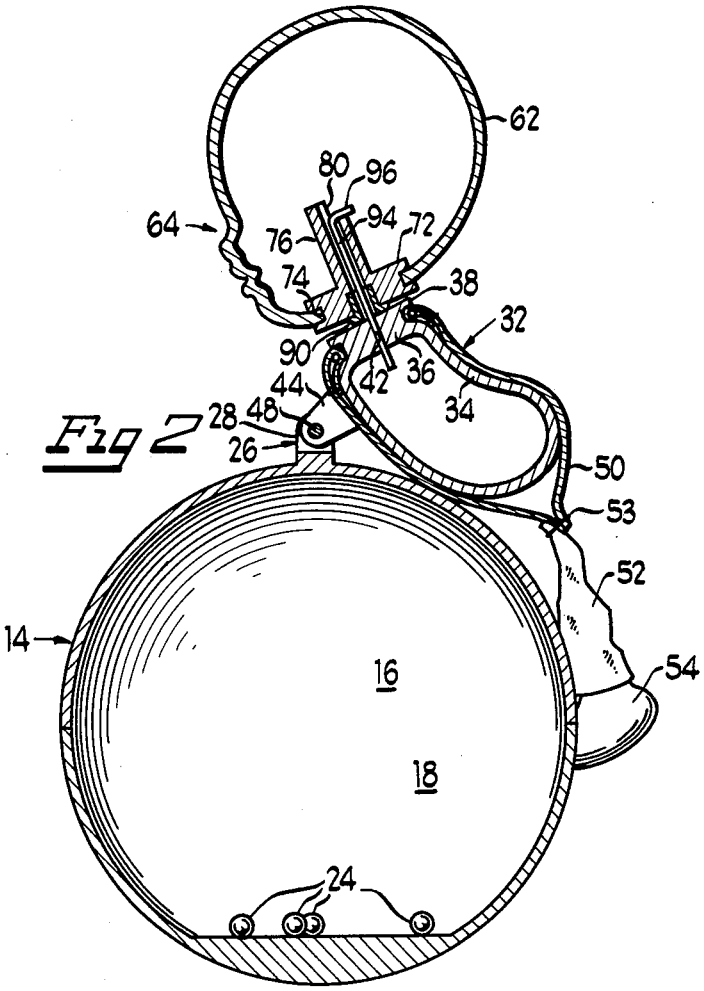
Fig 2
Fig 3
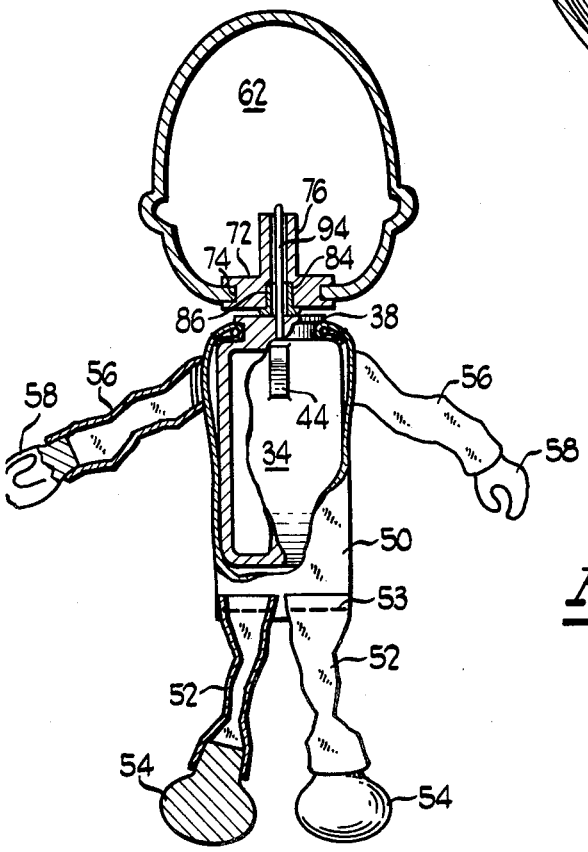
Fig 4
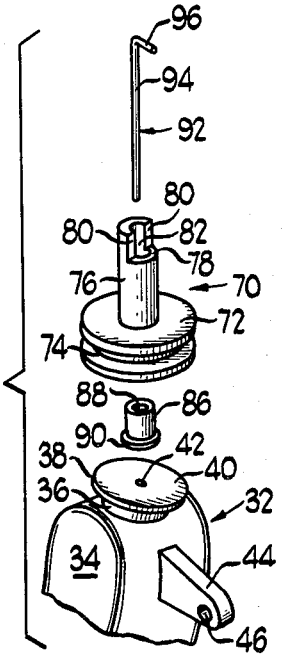

ARTICULATED DOLL MOUNTED ON A BALL

BACKGROUND OF THE INVENTION

1. Field of the Invention

This invention relates generally to dolls and more particularly to combinations of a doll with an eccentrically weighted ball.

2. Background Art

Characters or dolls have long been combined with balls to produce amusing toys for children. Thus, for example, heads have been added to an eccentrically weighted ball opposite the weight to form a character as in U.S. Pat. Nos. 907,092; 2,403,531; and 2,499,743. Other prior art combinations have placed a doll, character or other object within a ball such as in U.S. Pat. No. 2,554,516 in which a clown is spring mounted within an eccentrically weighted egg with a transparent top and U.S. Pat. Nos. 3,058,261 and 4,203,251 wherein the object is mounted for rotation inside a hollow transparent ball. While such prior art combinations provide toys that are enjoyed by children because of their visual effect, they do not provide the child with an opportunity to simulate real-life situations with the toy as children often wish to do when playing with dolls.

SUMMARY OF THE INVENTION

The present invention is concerned with providing a combination doll and ball toy with which a child can simulate activities that the child itself has experienced in playing with a ball. This and other objects and advantages of the invention are achieved by means of combining a doll with a ball having an eccentric weight such that when the ball is moved about a supporting surface, the doll appears to be holding on to the ball as well as playing and rolling around with the ball. A doll torso is pivotally connected to the ball and legs hingedly connected to the torso are biased toward the ball. The doll's head is mounted for swiveling with respect to the torso so that the head moves from side-to-side as the ball wobbles. Arms and hands extending from the torso may also be connected to the outside surface of the ball.

BRIEF DESCRIPTION OF THE DRAWINGS

For a better understanding of the present invention, reference may be had to the accompanying drawings in which:

FIG. 1 is a perspective view of one embodiment of the present invention;

FIG. 2 is an enlarged sectional view taken generally along the line 2—2 of FIG. 1;

FIG. 3 is an enlarged front elevational view, partially in section, of the doll shown in FIG. 1; and FIG. 4 is an exploded perspective view of some of the connecting parts of the doll.

DETAILED DESCRIPTION OF THE PREFERRED EMBODIMENT

Referring now to the drawings in which like parts are designated by like reference numerals throughout the several views, there is shown in FIG. 1 a toy 10 combining a doll 12 mounted on a roly-poly type ball 14 for movement of the doll with respect to the ball. The ball 14 is conveniently formed of an upper hemispherical half 16 and a lower hemisphere 18 joined together by suitable adhesives, ultrasonic welding, or the like. Lower hemisphere 18 is provided with a bottom weight 22 which may be fixed and may also, or alternatively, be provided with movable weights such as lead balls 24 or bells (not shown) that will also produce an amusing sound as the roly-poly ball 14 is moved about a surface.

Projecting radially upwardly from approximately the top center of the upper hemisphere 16 is a mounting fork 26 having two substantially identical parallel tines 28. Aligned transverse holes 30 extend through each tine 28.

Doll 12 has a torso 32 with a substantially rigid, plastic molded, hollow skeleton member 34 in a shape roughly conforming to that of a human torso. The upper part of the member 34 has an outwardly extending neck collar 36 terminating in a flange 38 which has a substantially planar disc surface 40. Bore 42 extends through the neck 36 at approximately the center of the disc 40. Mounting strut 44 having a transverse bore 46 near the free end extends out from the chest portion of the member 34. A pin 48 is fitted through the bore 46 in the strut 44 and the holes 30 in the fork 26. The pin 48 is press fit into the holes 30 and journaled for rotation in the bore 46 so that the doll is securely mounted on the ball but permitted pivotal movement about the pin 48. Alternatively, the press fit and journal could be reversed.

Skeleton member 34 has a soft flexible fabric covering 50 that is secured below the flange 38 and hangs down below the bottom of member 34. Adjacent the bottom of the covering 50 a pair of legs 52 is attached. In the embodiment described the legs 52 are made of a soft flexible fabric and, hence, may be hingedly attached by stitching 53 or a suitable adhesive. As is apparent from FIG. 2, the stitched hinge 53 results in the free ends of the legs being biased in toward the surface of the ball. The bottoms of the legs 52 are provided with foot blocks 54 that are preferably formed of a denser material and have a harder outer surface than the legs 52. Soft fabric arms 56 may be attached to the torso covering 50 in a manner similar to the legs. The ends of the arms 56 are provided with simulated hands 58 formed in a grasping position.

In addition to the pivotal connection between the fork 26 and strut 44, the doll 12 is also attached to the ball 14 by means of pegs 60 that extend transversely with respect to a chord on the ball passing through the strut. Hands 58 may be integrally formed with the pegs 60 which may then be inserted in suitable apertures formed in the upper hemisphere 16 of the ball. Alternatively, the pegs may be integrally molded to the hemisphere or otherwise attached and the grasping hands 58 fitted onto the pegs 60. With either assembly, the doll 12 is so mounted on the ball 14 that it gives the appearance that the doll is holding on to the ball with its hands 58. The flexibility of the fabric arms permits movement of the torso around the pin 48 toward and away from the surface of the ball. Attachment of the arms to the torso also provides flexibility and rotation of the peg either with respect to the ball or the grasping hands could also be provided.

The doll's head 62 is a hollow molded piece with performed facial features 64. Simulated hair 66 may be integrally molded or provided by attachment of another material. A cap or hat 68 which is preferably "floppy" to produce action is attached to the head. Mounting member 70 having a lower disc portion 72 with an annular groove 74 at approximately the center of the height of the disc is used to mount the head 62 to the torso skeleton 32. The width of the annular groove 74 is approximately equal to the thickness of the molded head 62 with the diameter of the groove roughly corresponding to the diameter of an opening in the bottom of the head 62 so that the molded head may be snapped over the disc 72 and retained by the groove 74 as shown in FIGS. 2 and 3.

An upwardly projecting cylindrical post 76 extends from the disc 72 into the hollow interior of the head 62. The post 76 has a semi-cylindrical section notched out of the upper free end toward the rear of the head 62 to provide a horizontal riding surface 78 and vertical abutments 80. A hole 82 extends through the post 76 and the disc 72 with a counterbore 84 near the outside of the disc 72 for receiving a bearing bushing 86. An aperture 88 of approximately the same diameter as the main length of the hole 82 extends through bushing 86. Lower bearing head 90 if a diameter larger than the counterbore 84 is formed on one end of the bushing.

L-shaped mounting rod 92 has a long leg 94 of a diameter less than the holes 82 and 88 but significantly greater than the diameter of bore 42 so that the rod is press fit or staked into the neck portion 36 of the torso skeleton member 34. As is best shown in FIG. 2, the bore 42 is not perpendicular to the surface 40 so that the head 62 is mounted on the torso 32 with the front of the head tilted or canted upwardly. The head 62 is so formed, as will be appreciated from FIG. 2, that the center of gravity from front to back is to the rear of the axis through the long leg 94 of the rod 92. The center of gravity of the head is also behind a radial projection passing through the center of the pin 48. Thus, as the ball 14 wobbles there will be a tendency for the head to swivel around the axis of the rod 92 because of the offset center of gravity. Short leg 96 of the L-shaped mounting rod 92 controls the degree of rotation of the head 62. The leg 96 rides freely on the horizontal surface 78 of the post 76 but is limited to approximately 180 degrees of rotation by the abutments 80. Accordingly, as the ball 14 wobbles about a surface the head 62 of the doll 12 will swivel from one side to the other side.

The hinged connection of the legs 52 to the torso covering 50 together with the weight of the feet 54 biases the bottom of the leg in toward the ball. As the ball wobbles about the floor the torso will pivot around the pin 48 such that the face of the head 62 will approach the surface of the ball and then back away and the legs and more particularly the feet 54 will bounce away and toward the ball as well as coming into contact with the surface on which the ball is being rolled, giving the appearance of the doll grasping the ball and dancing around the surface with it as well as trying to hold on to and roll over the ball.

Of course, a variety of doll appearances may be used such as a clown, or even animal characters such as a dog or a bear. While particular embodiments of the present invention have been illustrated and described, it will be apparent to those skilled in the art that various changes and modifications may be made. It is intended in the appended claims to cover all such changes and modifications that fall within the true spirit and scope of the present invention.

What is claimed as new and desired to be secured by Letters Patent is:

1. A toy comprising:
an articulated doll having a torso;
the torso including a substantially rigid portion and having a neck end and a bottom end;
first and second pairs of elongated, flexible appendages;
each appendage being hingedly connected at one end to the torso;
one of the first and second pairs of appendages connected adjacent the neck end and the other pair connected adjacent the bottom end;
a hollow sphere with an internal eccentric weight;
means pivotally connecting the substantially rigid portion of the torso to the exterior surface of the sphere for pivotal movement of the doll with respect to the sphere;
the other end of each of the first appendages connected to the surface of the sphere; and
the other end of each of the second pair of appendages being free.

2. The toy of claim 1 including:
a flexible fabric cover on the rigid portion of the torso; and
stitching attaching the appendages to the cover.

3. The toy of claim 1 in which the free ends are weighted.

4. The toy of claim 3 in which:
the second pair of appendages are legs connected to the bottom end of the torso;
the legs are biased in toward the exterior surface;
feet are attached to the free ends; and
the feet are more dense than the legs.

5. The toy of claim 1 in which:
the first pair of appendages are arms; and
the free ends of the arms are attached to the exterior surface of the sphere.

6. The toy of claim 5 in which the free ends of the arms are pivotally mounted with respect to the exterior surface of the sphere.

7. The toy of claim 1 in which
a head is mounted on the torso for limited rotational movement with respect to the torso.

8. The toy of claim 7 in which the center of gravity of the head is offset from the axis about which the head rotates.

9. The toy of claim 1 in which the eccentric weight is movable within the hollow sphere.

10. A toy comprising:
an articulated doll having a torso;
a ball formed of two hemispheres;
an internal eccentric weight inside of one hemisphere;
mounting means at a first point on the surface of the other hemisphere;
the torso being connected to the mounting means for pivotal movement about an axis perpendicular to the radius between the center of the ball and the first point;
a second mounting means provided on a second point on the surface of the other hemisphere;
the first and second points defining a first chord;
a first appendage connected at one end to the torso;
the other end of the first appendage being in proximity to the surface and mounted to the surface on the second point; and
the first appendage including flexible means permitting pivotal movement of the torso with respect to the surface of the ball.

11. The toy of claim 10 in which
legs are hingedly connected at one end to the torso with the legs being biased in toward the ball.

12. The toy of claim 10 in which:
the torso including a flexible fabric cover; and the appendage is attached to the cover by stitching.

13. The toy of claim 10 in which:

feet are attached to the other end of each of the legs; and the feet are more dense than the legs.

14. The toy of claim 10 in which a head with a top and bottom is mounted on the torso for movement about a swivel axis extending into the doll head perpendicular to the pivot axis and at an angle to the radius between the center of the ball and the first point.

15. The toy of claim 14 in which the doll head has a center of gravity displaced from a center line passing through the center of the ball and the pivot axis such that the head moves from side-to-side when the ball moves.

16. The toy of claim 15 in which the head has a face and a back and the center of gravity is between the swivel axis and the back of the head.

17. The toy of claim 10 in which:

a third mounting means is provided on a third point on the surface of the other hemisphere;

the first and third points define a second chord;

a second appendage is connected at one end to the torso;

the other end of the second appendage is in proximity to the surface and is mounted to the surface on the third point; and the second appendage includes flexible means permitting pivotal movement of the torso with respect to the surface of the ball.

18. The toy of claim 17 in which the first and second appendages are arms.

19. The toy of claim 10 in which the appendage is flexible.

20. The toy of claim 10 in which the mounting on the second point permits pivotal movement of the appendage about the point.

* * * * *